US012736301B2

(12) United States Patent
Bellitti et al.

(10) Patent No.: US 12,736,301 B2
(45) Date of Patent: Sep. 15, 2026

(54) RIFLE CHASSIS INTERLOCK TO RIFLE STOCK DEVICE AND SYSTEM

(71) Applicant: AMEND2, LLC, Idaho Falls, ID (US)

(72) Inventors: Matthew Bellitti, Idaho Falls, ID (US); Austin Damoth, Idaho Falls, ID (US); Craig Lockwood, Idaho Falls, ID (US)

(73) Assignee: Amend2, LLC, Idaho Falls, ID (US)

( * ) Notice: Subject to any disclaimer, the term of this patent is extended or adjusted under 35 U.S.C. 154(b) by 0 days.

(21) Appl. No.: 18/097,653

(22) Filed: Jan. 17, 2023

(65) Prior Publication Data

US 2023/0228520 A1 Jul. 20, 2023

Related U.S. Application Data

(60) Provisional application No. 63/345,567, filed on May 25, 2022, provisional application No. 63/299,818, filed on Jan. 14, 2022, provisional application No. 63/299,827, filed on Jan. 14, 2022.

(51) Int. Cl.

| | |
|---|---|
| ***F41C 23/06*** | (2006.01) |
| ***F41A 3/64*** | (2006.01) |
| ***F41A 3/66*** | (2006.01) |
| ***F41A 11/00*** | (2006.01) |
| ***F41A 11/02*** | (2006.01) |
| ***F41C 23/00*** | (2006.01) |

(52) U.S. Cl.

CPC ..... *F41C 23/06* (2013.01); *F41A 3/64* (2013.01); *F41A 3/66* (2013.01); *F41A 11/00* (2013.01); *F41A 11/02* (2013.01); *F41C 23/00* (2013.01)

(58) Field of Classification Search

CPC .. F41A 11/00; F41A 11/02; F41A 3/66; F41C 23/06

USPC ..... 42/71.01, 75.03

See application file for complete search history.

(56) References Cited

U.S. PATENT DOCUMENTS

| | | | | | |
|---|---|---|---|---|---|
| 694,156 | A * | 2/1902 | Johnson | F41A 3/66 | 42/75.03 |
| 1,996,124 | A * | 4/1935 | Rowley | F41A 11/00 | 42/75.03 |
| 2,867,931 | A * | 1/1959 | Schreiber | F41A 21/485 | 42/75.01 |
| 3,439,441 | A * | 4/1969 | Lawley | F41C 23/00 | 42/75.01 |
| 5,339,789 | A * | 8/1994 | Heitz | F41A 25/00 | 42/1.06 |
| 5,410,834 | A * | 5/1995 | Benton | F41A 21/484 | 42/75.02 |
| 6,637,142 | B1 * | 10/2003 | Reynolds | F41A 21/485 | 42/1.06 |
| 7,162,823 | B2 * | 1/2007 | Schoppman | F41C 23/20 | 42/75.01 |
| 7,770,317 | B1 * | 8/2010 | Tankersley | F41C 23/16 | 42/71.01 |
| 8,015,740 | B2 * | 9/2011 | Jamison | F41A 21/00 | 42/2 |

(Continued)

*Primary Examiner* — Troy Chambers
*Assistant Examiner* — Benjamin S Gomberg
(74) *Attorney, Agent, or Firm* — Travis Banta; Ascent IP Law

(57) ABSTRACT

A chassis locking system includes a bolt having a cross pin and a chassis. The chassis includes a helically inclined surface that contacts the cross pin of the bolt as the bolt is turned, tightening the chassis to a rifle stock.

20 Claims, 5 Drawing Sheets

(56) References Cited

U.S. PATENT DOCUMENTS

| | | | | |
|---|---|---|---|---|
| 8,220,194 | B2 * | 7/2012 | Crow | F41A 21/482 42/75.02 |
| 8,397,417 | B2 * | 3/2013 | Jamison | F41A 21/485 42/75.03 |
| 8,707,605 | B2 * | 4/2014 | Jamison | F41A 11/00 42/75.03 |
| 10,859,342 | B2 * | 12/2020 | Ludlow | F41C 23/16 |
| 2003/0029070 | A1 * | 2/2003 | Dowding | F41C 23/00 42/75.03 |
| 2010/0071243 | A1 * | 3/2010 | Lesenfants | F41A 5/18 42/69.01 |
| 2012/0180360 | A1 * | 7/2012 | Jones | F41C 23/20 42/75.03 |
| 2021/0148662 | A1 * | 5/2021 | Kolev | F41A 3/46 |
| 2023/0258423 | A1 * | 8/2023 | Coombs | F41A 11/00 42/75.03 |

* cited by examiner

RIFLE CHASSIS INTERLOCK TO RIFLE STOCK DEVICE AND SYSTEM

PRIORITY CLAIM

This application claims the priority and benefit of U.S. Provisional Patent Application No. 63/299,818 filed on Jan. 14, 2022, U.S. Provisional Patent Application No. 63/299,827 filed on Jan. 14, 2022, and U.S. Provisional Patent Application No. 63/345,567 filed on May 25, 2022, which are each incorporated by reference in their respective entireties.

BACKGROUND

Modern bolt action rifles have been developed to be precision tools. However, this precision came about due to many years of examination, testing, and engineering to correct elements of bolt action rifles that made these rifles less precise.

Bolt action rifles were a natural improvement in breech loading rifles that used percussion caps. As metallic cartridge ammunition was developed, there was less need or desire to interact with the generation of the spark necessary to ignite a rifle shot in percussion rifles, for example. The fact that many of these rifles were particularly dirty due to the use of black powder and external percussion caps were also a major drawback to breech loading rifles. While some bolt action rifles operated with black powder breech loading mechanism, these bolt action rifles are not considered modern bolt action rifles due to their use of black powder instead of smokeless powder and cartridge ammunition.

The first modern bolt action rifles were developed just prior to the American Civil War and became highly desirable due to their relative accuracy and the repeatability of firing with cartridge ammunition. The number of shots that a soldier could fire increased significantly with the development of the repeating rifle, specifically lever action and bolt action rifles. Further, development of bolt action rifles was not limited to the United States. Popular European and Russian designs such as the Mauser, Lee-Enfield, and Moisin-Nagant used bolt actions. The United States Springfield M1903 was the battle rifle of choice for American soldiers in World War I and featured a Mauser style bolt action design. For the time, bolt action rifles had an unrivaled and incomparable accuracy for a variety of reasons. Among those reasons are that a rotating bolt secured a single ammunition cartridge into a chamber of a rifle. The bolt was used to extract a spent case, cock the trigger for subsequent firing, and loading a new cartridge into the chamber. Once the new cartridge is secured in the chamber, the bolt was locked and held motionless to secure that ammunition cartridge into the chamber of the rifle. This "fixed" position for the bolt relative to the ammunition cartridge and chamber of the rifle in a bolt action rifle provides a significant improvement in the accuracy and precision of a rifle.

It would be unfair to say that bolt action rifles lost favor after World War I because bolt action rifles are extremely popular for hunters, particularly those hunters that pursue big game and/or dangerous game. However, a division occurred at the beginning of World War II when the semi-automatic rifle became the standard battle rifle for soldiers entering the conflict. While early on in World War II, the M1903 Springfield bolt action rifle was used, it soon gave way to the M1 Garand, which soldiers hailed as one of the primary reasons for the American victories in the European and Pacific theaters. At the same time, the Russian and German standard soldier battle rifle was still a bolt action rifle. Thus, even though the United States moved into the realm of semi-automatic rifles, bolt action rifles were still prized for their simplicity and accuracy, which even surpassed the accuracy of the new semi-automatic rifles. Bolt action rifles have, since their advent, been the preferred rifle for snipers because of the precision and accuracy native to their design.

Modern bolt action rifles are still, even today, the weapon of choice for long range or precision shooting and hunting as mankind has yet to develop a more accurate single-man usable rifle that is more accurate than a bolt action rifle. Thus, bolt action rifles are highly prized for hunting and long range shooting applications. Bolt action rifles not only have the ability to be accurate in any caliber, but also have the potential to be hyper-accurate.

Hyper-accurate bolt action rifles are typically, however, improved from factory condition. While many manufacturers guarantee sub-minute-of-angle accuracy from the factory, many bolt action rifles are simply not that accurate due to the mass production of parts. In a bolt action rifle, for example, a portion of a stock contacting the barrel of the rifle may cause significant reductions in the relative accuracy of the rifle. Loose stock screws, expansion of the barrel due to multiple subsequent shots, barrel thickness, ambient temperatures, and a host of other factors can cause a rifle to lose accuracy that it would have in ideal conditions. To address many of these issues, enthusiasts replace barrels to be less sensitive to temperature changes and perform a task called "bedding the action" to ensure that the bolt action rifle fits securely and exactly into a rifle stock. Enthusiasts may also "free float" the barrel to ensure that the barrel does not come into contact with a rifle stock at any point and is only connected to the action of the rifle at a single point, typically by screwing the barrel into the action of the rifle. Many of these improvements are simply not available in a factory configuration. Notwithstanding, these improvements are imperative to obtaining hyper accuracy in a bolt action rifle.

One drawback is that to bed the action of a rifle and to free float a barrel in a rifle stock requires that the same rifle stock be used regardless of whether a person is hunting or target shooting. Thus, these stocks can be suitable for hunting or for long range target shooting, but typically not both. Typically, hunters who are hiking and stalking game desire a lighter stock that is easier to carry. Target shooters prefer stocks that are heavier and more ergonomic because they are not required to pack a rifle in search of game. Most target shooting is done from either a sitting position on a bench or in a prone position lying down on the ground where the weight of a rifle will not be a factor.

Many people who both hunt and shoot targets at long range have multiple stocks that are switched out for different activities. This requires that each stock be properly bedded for a particular rifle action and free floated to ensure that shooting performance is equal between the different stocks. Thus, using different stocks requires significant expense in bedding two different rifle actions and free floating the barrels. In addition, the rifle's "zero," or point of aim must be adjusted each time a rifle stock is changed (e.g., the positioning of the rifle scope relative to how the action is fit into the stock). This requires that the shooter shoot the rifle to re-zero the rifle, which also takes considerable time and expense in ammunition necessary to zero the rifle.

Thus, there is a need and desire in the hunting and long range shooting community, for a system which allows shooters to change stocks without having to re-zero a bolt action rifle. There is also a need and desire in the hunting and long range community to provide an easy to use simple interlocking system to attach a rifle action and barrel to a stock without significant tools, time, or changes to the rifle.

SUMMARY OF THE DISCLOSURE

Disclosed herein is a device for locking a bolt action rifle chassis to a rifle stock. The device includes a chassis which connects to a rifle stock and to an action of a bolt action rifle. The chassis includes a rear bolt hole and a front bolt hole. The rear bolt hole and the front bolt hole include a helically inclined surface.

Disclosed herein is also a chassis locking system for locking a bolt action rifle chassis to a rifle stock. The chassis locking system includes a bolt. The bolt includes a cross pin. The chassis further includes a helically inclined surface that contacts the cross pin of the bolt as the bolt is turned.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

In the following description of the disclosure, reference is made to the accompanying drawings, which form a part hereof, and in which is shown by way of illustration specific implementations in which the disclosure is may be practiced. It is understood that other implementations may be utilized, and structural changes may be made without departing from the scope of the disclosure.

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are displayed or described in another embodiment or figure. In other words, elements in the figures may be interchangeable between various embodiments disclosed herein, whether shown or not.

Figure 1:
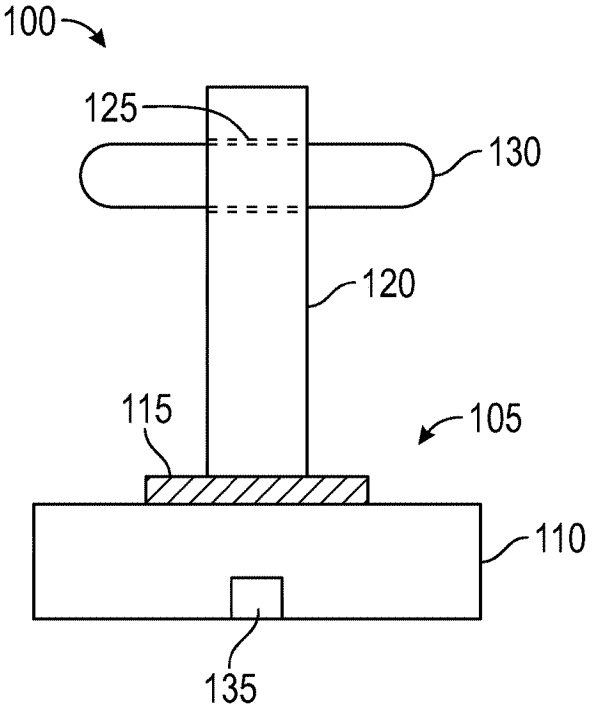
FIG. 1 illustrates a horizontal view of a bolt.

FIG. 1 illustrates a horizontal view of a bolt device 100. Bolt device 100 may be implemented as a stock bolt 105, which is used to attach a bolt action rifle chassis to a rifle stock. Bolt device 100 and stock bolt 105 are not to be confused with a bolt handle that is a feature of a bolt action rifle. Rather, stock bolt 105 is intended to specifically be used to connect a bolt action rifle chassis to a rifle stock, as will be discussed below. Stock bolt 105 may include a head 110 and a shaft 120 connected to head 110. An O-ring or a spacer 115 may be fitted around shaft 120 and positioned on shaft 120 adjacent to bolt head 110. Bolt shaft 120 may further be fitted with an aperture 125 which allows a cross pin 130 to be disposed through aperture 125.

In one embodiment, cross pin 130 and aperture 125 may be complimentary shapes. In other words, cross pin 130 and aperture 125 may both be oval and may be permanently or semi-permanently attached to each other by welding or other techniques known in the art that are appropriate for various materials that would be suitable for forming stock bolt 105. Cross pin 130 may be disposed at an angle that is substantially perpendicular to bolt shaft 120 and substantially parallel to bolt head 110 where the word substantially means within manufacturing tolerances. Bolt head may include an interface feature 135 which may be, for example, knurling which allows a user to turn the bolt by hand. Interface feature 135 may include any element or feature that assists the user turning bolt 105 by hand or with a tool which are known to those of ordinary skill in the art, including but not limited to a slot or other depression within bolt head 110 that corresponds to a screwdriver.

Figure 2A:
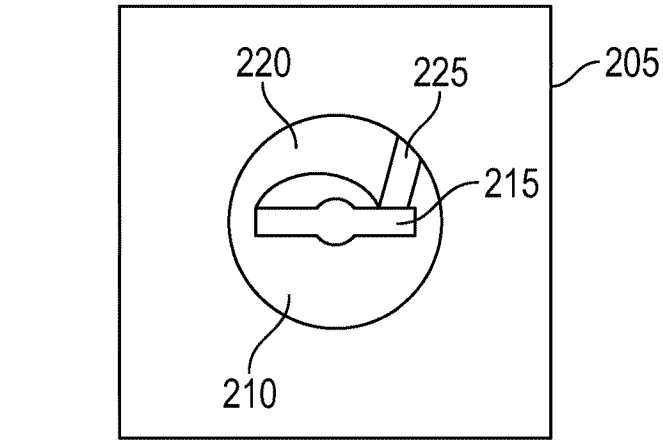
FIG. 2A illustrates a top view of a chassis lock.

FIG. 2A illustrates a top view of a chassis lock device 200. Chassis lock device 200 may be implemented as a chassis lock 205 which may be machined or printed using metal or metal filaments to ensure that chassis lock 205 is resilient enough to withstand pressure exerted by bolt 105, as will be described below. It should be noted that chassis lock device 200 may be implemented using any material known to those of ordinary skill in the art and is not limited to metals and metal filaments.

Chassis lock 205 may include a hole 210 which may be generally circular in shape, which is cut into a top surface of chassis lock 205 and which does not extend all the way through a thickness of chassis lock 205. Rather, hole 210 is merely inset into a top surface of chassis lock 205. Within hole 210 may be an aperture 215 which may be shaped to accommodate bolt 105 being inserted through a bottom surface of chassis lock 205. For example, aperture 215 may be an elongated oval or circle having a circular midpoint to allow bolt shaft 110 and cross pin 130 to slide through aperture 215. Hole 210 may include a surface 220 that is helically inclined from one side of aperture 215 to a detent 225, as will be discussed below.

Figure 2B:
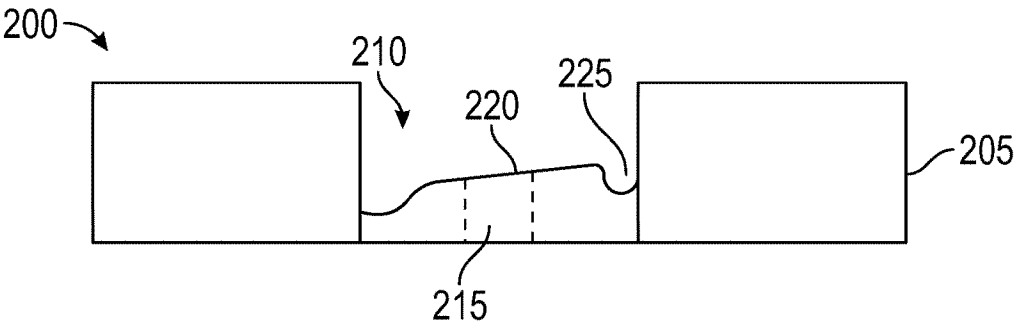
FIG. 2B illustrates a side view of the chassis lock.

FIG. 2B illustrates a side view of the chassis lock device 200. Chassis lock device 200 may be implemented as a chassis lock 205 which may be machined or printed using metal or metal filaments to ensure that chassis lock 205 is resilient enough to withstand pressure exerted by bolt 105, as will be described below. It should be noted that chassis lock device 200 may be implemented using any material known to those of ordinary skill in the art and is not limited to metals and metal filaments.

Chassis lock 205 may include a hole 210 which may be generally circular in shape, which is cut into a top surface of chassis lock 205 and which does not extend all the way through a thickness of chassis lock 205. Rather, hole 210 is merely inset into a top surface of chassis lock 205. Within hole 210 may be an aperture 215 which may be shaped to accommodate bolt 105 being inserted through a bottom surface of chassis lock 205. For example, aperture 215 may be an elongated oval or circle having a circular midpoint to allow bolt shaft 110 and cross pin 130 to slide through aperture 215.

Hole 210 may include a surface 220 that is helically inclined from one side of aperture 215 to a detent 225. Helically inclined surface 220 may interact with one side of cross pin 130 of bolt 105 as bolt 105 is turned. For example, as bolt 105 is turned, helically inclined surface 220 causes cross pin 130 to follow the helically inclined surface which increases pulling tension between bolt head 110 and cross pin 130 to secure a rifle stock (when installed) to chassis lock 205 (when disposed within a chassis). Detent 225 allows cross pin 130 to come to a stop where a consistent pressure is applied between a rifle stock and a chassis regardless of how many times the stock is removed from the chassis or whether or not a different stock is secured to a chassis. This implementation will be further discussed below.

Figure 3A:
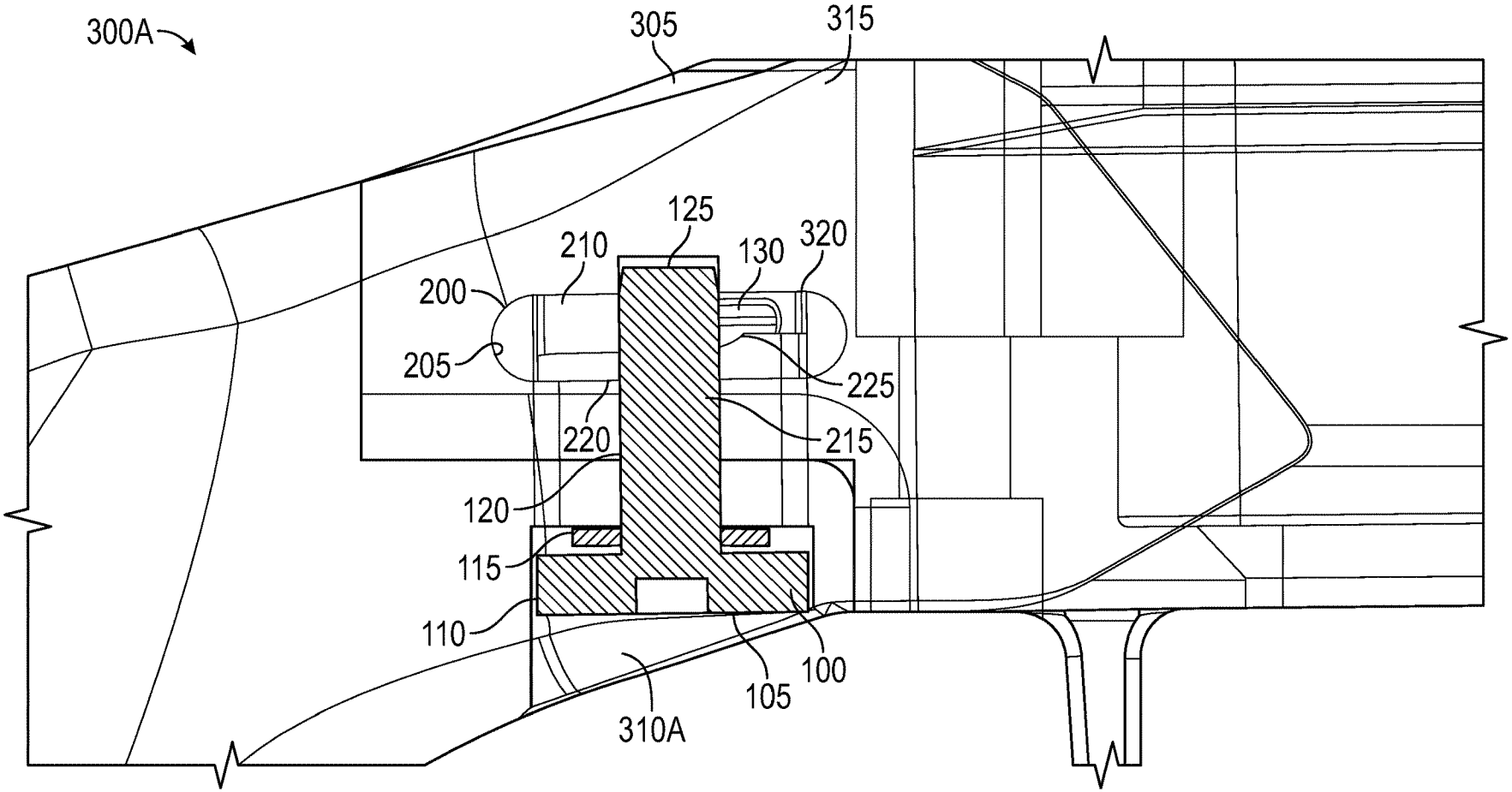
FIG. 3A illustrates a cross sectional view of the chassis lock installed in a rifle stock.

FIG. 3A illustrates cross sectional view 300A of the chassis lock 205 installed in a rifle stock 305. As shown in FIG. 3A, a bolt device 100 is installed within a hole 310A in a rifle stock. Bolt device 100 includes a bolt 105 which implements a bolt head 110, a spacer 115, a bolt shaft 120, an aperture 125, and a cross pin 130 in a manner that is described above with respect to FIG. 1. Also shown in FIG. 3A is a chassis lock device 200 which includes a chassis lock 205 that implements a hole 210, an aperture 215, a helically inclined surface 220, and a detent 225 in a manner that is described above with respect to FIG. 2A and FIG. 2B. FIG. 3A further includes a chassis 315 which is locked into rifle stock 305.

As shown in FIG. 3A, chassis lock 205 may be installed within chassis 315. Chassis 315 may be milled to include a hole or an aperture 320 which chassis lock 205 may be installed within, preferably with exacting tolerances to prevent movement of chassis lock 205 within chassis 315. Once chassis lock 205 is installed within chassis 315, chassis 315 may be inserted into stock 315, noting that for the purposes of FIG. 3A, a rifle action is not shown. In practice, chassis 315 may be connected to an action of a bolt action rifle, however for purposes of clarity, FIG. 3A merely illustrates an exemplary implementation without a bolt action rifle action attached to chassis 315.

When chassis 315 is inserted into stock 305, bolt 105 may be installed in hole 310A of rifle stock 305. Bolt 105 may be aligned to allow cross pin 130 and bolt shaft 125 to pass through aperture 215 in chassis lock 205. As bolt 105 is turned, cross pin 130 contacts helically inclined surface 220 which pulls bolt device 100 up into hole 310A of rifle stock 305 and begins applying compression pressure between rifle stock 305 and chassis 315 to hold chassis 315 in place relative to rifle stock 305.

Once sufficient compression pressure has been achieved due to the angle of helical incline in helically inclined surface 220, cross pin 130 contacts a detent 225 which allows cross pin 130 to come to a rest within detent 225 and remain within detent 225, applying appropriate compression pressure between rifle stock 305 and chassis 315 to ensure a rigid connection between chassis 315 and stock 305. One further advantage of the implementation shown in FIG. 3A is that a rigid connection may be made between chassis 315 and stock 305 by turning bolt device 100 by half a turn or less.

Figure 3B:
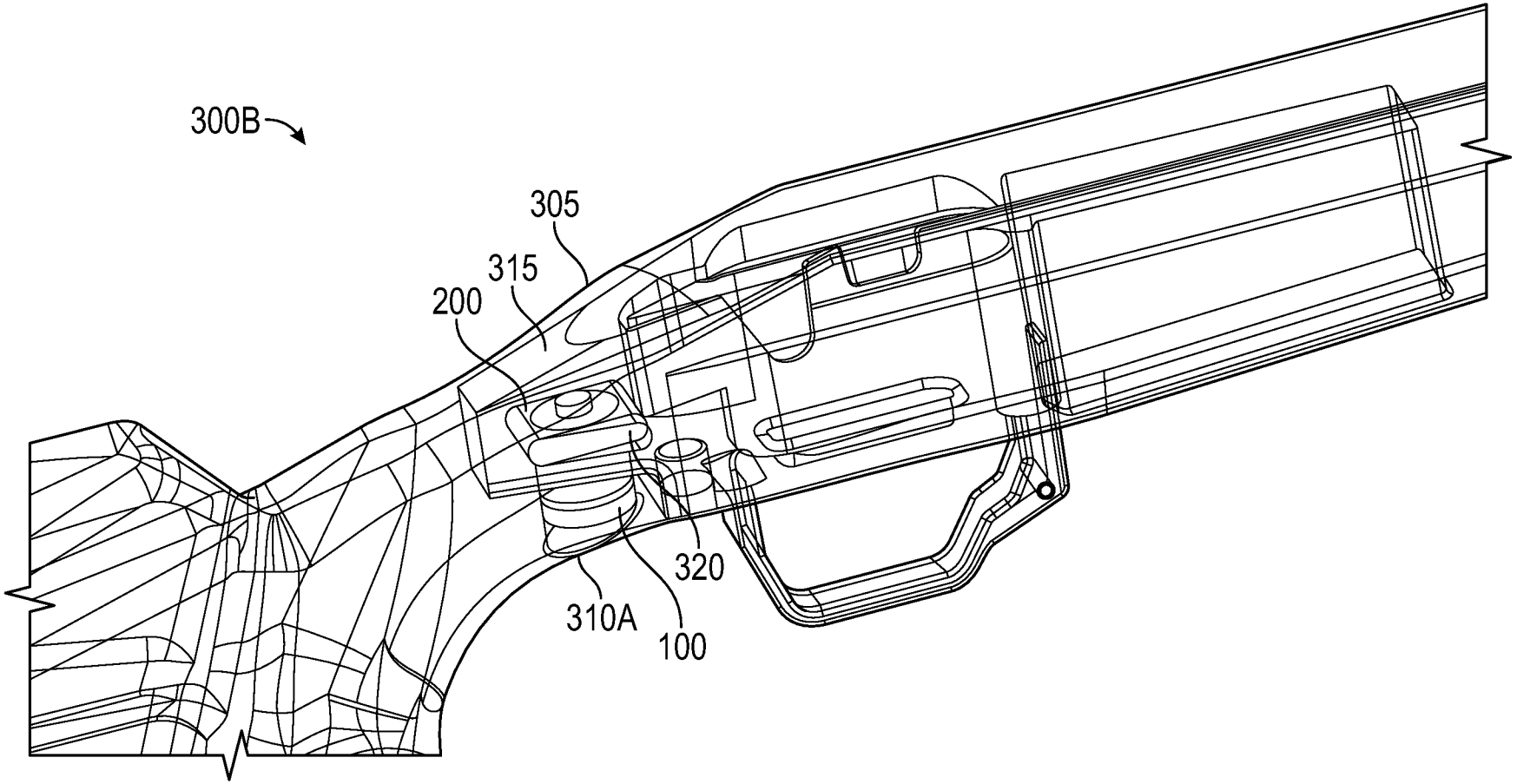
FIG. 3B illustrates a perspective view of the chassis lock installed in a rifle stock.

FIG. 3B illustrates a perspective view 300B of the chassis lock device 200 installed in a rifle stock 305. FIG. 3B offers a view 300B that illustrates a larger portion of rifle stock 305 to better visually relate the various elements discussed above with rifle stock 305. As shown in FIG. 3B, chassis lock device 200 is installed within a hole or aperture 320 of chassis 315. Chassis 315 is further installed within stock 305 by application of bolt device 100 being turned to secure chassis 315 to stock 305, as discussed above.

Advantageously, bolt device 100 may be easily inserted and removed into chassis 315 to allow stock 305 to be replaced in a relatively easy manner. Since chassis 315 is connected to an action of a bolt action rifle, the zero of the rifle is not changed when the rifle is attached to different stocks. Further issues with floating the barrel or bedding the action are effectively unnecessary due to chassis 315 maintaining relational accuracy between chassis 315 and a bolt action rifle action independent of the rifle stock 305. A stock 305 may be easily replaced to facilitate different shooting activities depending on preference for a particular shooting activity without losing accuracy or having to zero the rifle each time the stock is replaced.

Figure 4A:
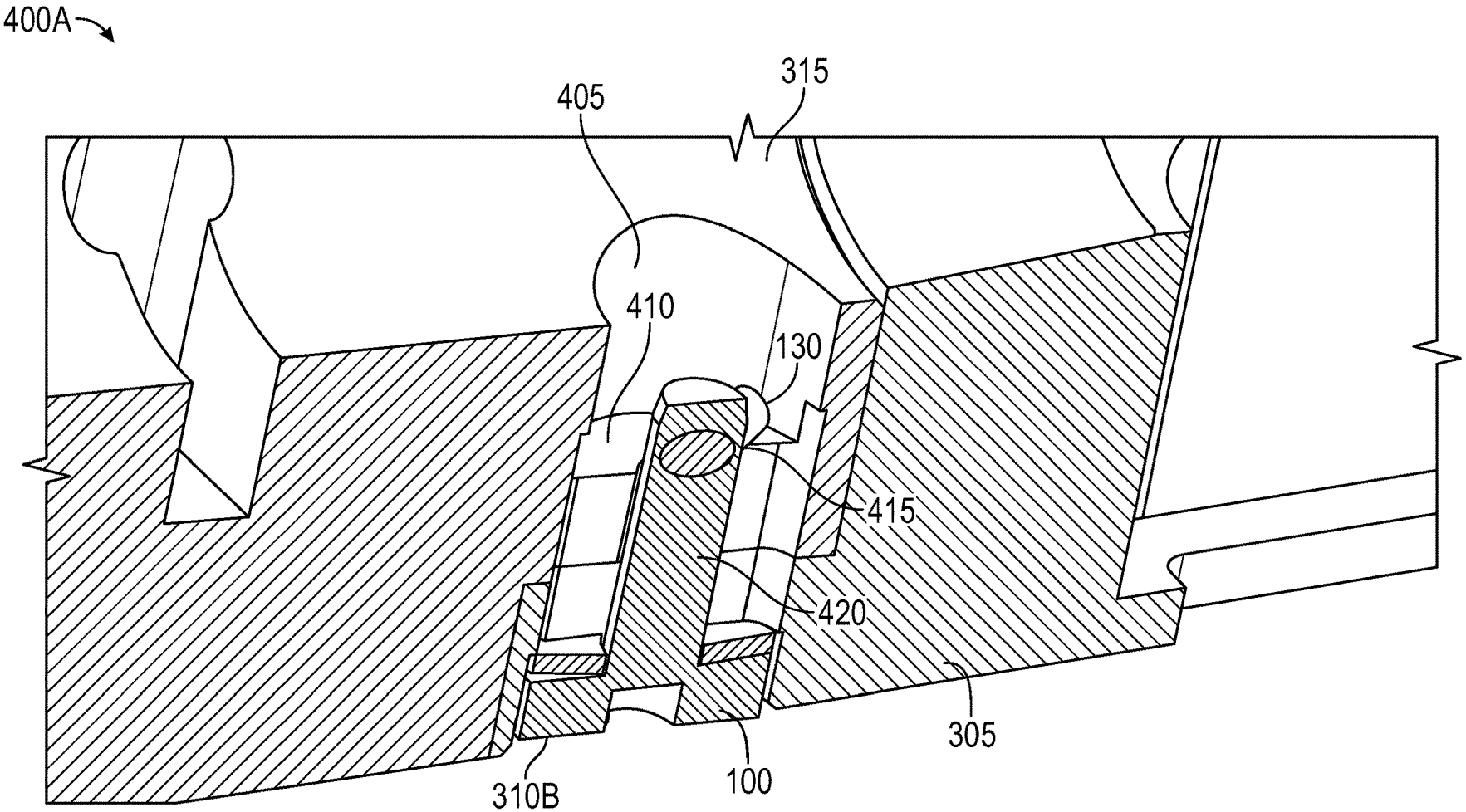
FIG. 4A illustrates a perspective view of a bolt installed in a chassis on a front end of the chassis.

FIG. 4A illustrates a perspective view 400A of a bolt device 100 installed in a chassis 315 on a front end of chassis 315. As shown in FIG. 4A, a chassis 315 is installed in a rifle stock 305. Chassis 315 may be the same chassis shown in FIGS. 3A and 3B. However, FIG. 4A illustrates a front end of the chassis 315 (e.g., and end of chassis 315 and stock 305 that is closer to the muzzle of the rifle than the end of chassis 315 and stock 305 shown in FIG. 3A and FIG. 3B) and how a front end of chassis 315 connects to stock 305 on a front end of stock 305.

Chassis 315 may include a hole 405, which may be generally circular in shape, which is cut or machined into chassis 315 and which does not extend all the way through a thickness of chassis 315. Rather, hole 405 is merely inset into chassis 315. Within hole 405 may be an aperture 420 which may be shaped to accommodate bolt 105 being inserted through a hole 310B in rifle stock 305 and in through a bottom surface of chassis 315. For example, aperture 420 may be an elongated oval or circle having a circular midpoint to allow bolt 105 and cross pin 130 to slide through aperture 420.

Hole 405 may include a surface 410 that is helically inclined from one side of aperture 420 to a detent 415. Helically inclined surface 410 may interact with one side of cross pin 130 of bolt 105 as bolt 105 is turned. For example, as bolt 105 is turned, helically inclined surface 410 causes cross pin 130 to follow the helically inclined surface which increases compression between bolt head 110 and cross pin 130 to secure a rifle stock 305 to chassis 315. Detent 415 allows cross pin 130 to come to a stop where a consistent pressure is applied between rifle stock 305 and chassis 315. In this manner, a front of chassis 315 may be secured to a front of rifle stock 305 to provide a second point of connection between chassis 315 and rifle stock 305.

Figure 4B:
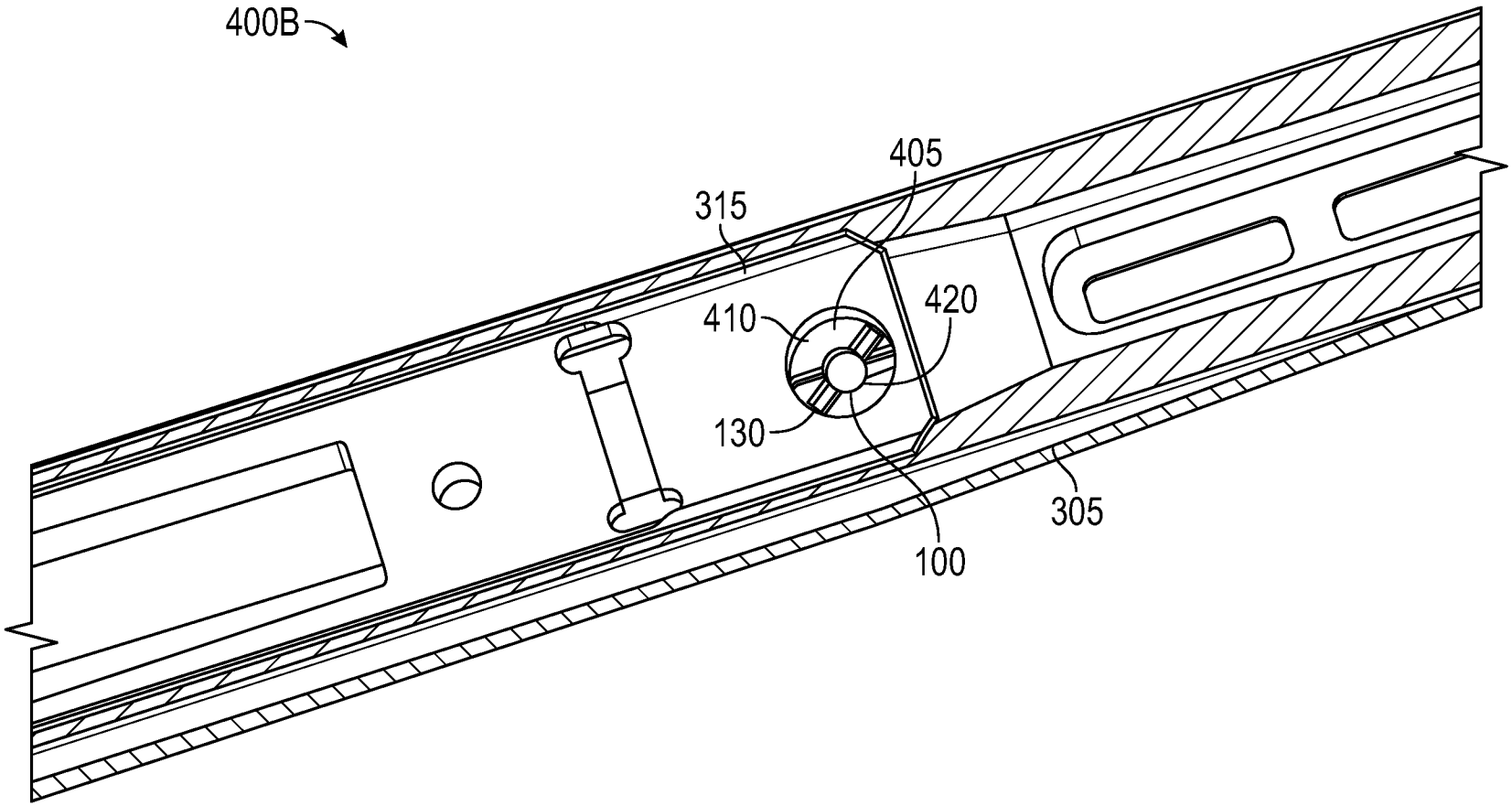
FIG. 4B illustrates a top view of a bolt installed in a chassis on a front end of the chassis.

FIG. 4B illustrates a top view 400B of a bolt device 100 installed in a chassis 315 on a front end of chassis 315. In other words, FIG. 4B illustrates a top view of the implementation shown in FIG. 4A and discussed above, As shown in FIG. 4B, a front end of chassis 315 is secured to stock 305 by a bolt 100 having a cross pin 130 that may be rotated around a helically inclined service 410 to provide compression between chassis 315 and stock 305. Bolt 100 may be inserted through stock 305 into hole 305 by an aperture 420 in chassis 315. Bolt 100 may be turned by half a turn, or less, and come to rest within a detent 415 which is positioned with a height sufficient to maintain a compression force between chassis 315 and stock 305 by cross pin 130 of bolt 100 being captured within detent 415.

In this manner, chassis 315 and stock 305 are connected on both a forward end, as shown in FIG. 4A and FIG. 4B, and a rear end, as shown in FIG. 3A and FIG. 3B by corresponding structures installed into both ends of chassis 315 and stock holes 310A/310B. The foregoing implementation serves several benefits including allowing users to easily swap rifle stocks without losing a zero on a rifle and allows for a simple connection between a stock and a rifle in a way that maintains the accuracy inherent to the design of the bolt action rifle.

It is further noted that the foregoing description has been described with respect to a bolt action rifle. However, this is not meant to disinclude the use of a chassis with other types of rifles having other types of actions. For example, it has been conceived that a chassis, such as chassis 315 may connect to a semi-automatic rifle using locking pins in lieu of take down screws which connect chassis 315 to a receiver of a semi-automatic rifle. Similarly, it has been conceived that a chassis, such as chassis 315 may be implemented for any rifle such as a fully automatic rifle, a semi-automatic rifle, a lever action rifle, or any other type of rifle. The disclosure is not limited to the use of a chassis with only a bolt action rifle action as a chassis may be implemented to conform with or attach to any type of rifle receiver with trivial changes for connecting to another type of rifle action.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A chassis device, comprising:

a chassis which is connectable between a rifle stock and a receiver of a bolt action rifle, the chassis including a rear bolt hole and a front bolt hole disposed on a bottom side of the chassis;

a first chassis lock device disposed in a front of the chassis and a second chassis lock device disposed in a rear of the chassis, the first chassis lock device and the second chassis lock device each including a hole inset into a top surface of the chassis at the first chassis lock device and the top surface of the chassis at the second chassis lock device, wherein the hole inset into the top surface of the first chassis lock and the second chassis lock includes a bottom that is formed as a helically inclined surface adapted to join the chassis to the rifle stock by a first bolt including a cross pin inserted into the rear bolt hole and a second bolt including a cross pin inserted into the front bolt hole, the cross pin of the first bolt and the cross pin of the second bolt interacting with the helically inclined surface to lock the chassis to the rifle stock.

2. The chassis device of claim 1, wherein the front bolt hole accepts the first bolt with the cross pin.

3. The chassis device of claim 1, wherein the rear bolt hole accepts the second bolt with the cross pin.

4. The chassis device of claim 1, wherein the helically inclined surface includes a detent.

5. The chassis device of claim 1, wherein the rifle stock receives and connects directly to the chassis.

6. The chassis device of claim 5, wherein the rifle stock includes a stock hole in a front end of the stock and a rear end of the stock which correspond to the front bolt hole and the rear bolt hole in the chassis, respectively.

7. The chassis device of claim 6, wherein the chassis is attachable to the rifle stock by the stock hole in the rear end of the rifle stock and the rear bolt hole in the chassis.

8. The chassis device of claim 6, wherein the chassis is attachable to the rifle stock by the stock hole in the front end of the rifle stock and the front bolt hole in the chassis.

9. The chassis device of claim 1, wherein the chassis maintains relational accuracy between an action of the bolt action rifle and the chassis when the chassis is removed or connected to the rifle stock.

10. A chassis locking system, comprising:

a bolt having a cross pin extending through the bolt; and a chassis lock including a hole inset into a top surface of a chassis lock and a bolt hole disposed in a bottom surface of the chassis, wherein a bottom of the hole inset into the top surface of the chassis is a helically inclined surface that contacts the cross pin of the bolt when the bolt is inserted through the bolt hole disposed in the bottom surface of the chassis lock and is turned to engage the cross pin with the helically inclined surface to lock the chassis to a rifle stock.

11. The chassis locking system of claim 10, wherein the helically inclined surface includes a detent at one end of the helically inclined surface.

12. The chassis locking system of claim 10, wherein the chassis is connectable to the rifle stock and to a receiver of a bolt action rifle.

13. The chassis locking system of claim 10, wherein the chassis includes a rear bolt hole and a front bolt hole.

14. The chassis locking system of claim 13, wherein the helically inclined surface of the chassis is disposed in the rear bolt hole.

15. The chassis locking system of claim 14, wherein the cross pin of the bolt interacts with the helically inclined surface of the chassis as the cross pin is turned to tighten the chassis to the rifle stock.

16. The chassis locking system of claim 15, wherein the helically inclined surface pulls the cross pin into the stock as the bolt is turned.

17. The chassis locking system of claim 13, wherein the helically inclined surface of the chassis is disposed in the front bolt hole.

18. The chassis locking system of claim 10, wherein the bolt includes a spacer.

19. The chassis locking system of claim 10, wherein the bolt includes an interface feature.

20. The chassis locking system of claim 19, wherein the interface feature comprises one or more of knurling, a slot, and a depression disposed within a head of the bolt.

* * * * *